United States Patent [19]

Mader

[11] 4,127,292

[45] Nov. 28, 1978

[54] SECURING DEVICE FOR FLEXIBLE FARM GATES

[76] Inventor: William J. Mader, Box 401, Crawford, Nebr. 69339

[21] Appl. No.: 827,358

[22] Filed: Aug. 24, 1977

[51] Int. Cl.[2] ..... E05C 17/36

[52] U.S. Cl. ..... 292/246; 160/328

[58] Field of Search ..... 49/34; 160/328; 292/246

[56] References Cited

U.S. PATENT DOCUMENTS

| | | | |
|---|---|---|---|
| 1,089,066 | 3/1914 | Meyer | 292/246 X |
| 1,282,368 | 10/1918 | Behl | 160/328 |
| 2,773,714 | 12/1956 | McKinney | 292/246 |
| 2,803,899 | 8/1957 | Denovan | 160/328 |
| 2,827,265 | 3/1958 | McKillop | 160/328 X |
| 3,799,595 | 3/1974 | Wahlert | 160/328 X |

*Primary Examiner*—Richard E. Moore

[57] ABSTRACT

A section of chain has its opposite ends anchored to a gate post and a pair of pulleys are secured to adjacent chain links near the center of the chain. A gate securing cable loop is trained over the pulleys and has a retractile coil spring connected thereto, the spring lying along one side of the gate post during usage. A clip on the lower end of the spring is selectively engageable with any one of several anchoring elements, such as staples, placed in the gate post in spaced relationship.

5 Claims, 3 Drawing Figures

SECURING DEVICE FOR FLEXIBLE FARM GATES

BACKGROUND OF THE INVENTION

A number of devices are known in the prior art for holding flexible farm or ranch gates securely in a closed position while allowing their quick release at proper times for the passage of livestock or vehicles. Examples of prior patented devices along this general line are shown in U.S. Pat. Nos. 1,397,459; 1,480,501; 3,285,322; 3,473,598; and 3,847,425.

Notwithstanding the teachings of the prior art, there still exists a need for a less expensive, simpler and more efficient securing device for flexible farm gates and the like, and it is the object of this invention ot improve on the prior art by completely satisfying this need.

SUMMARY OF THE INVENTION

A length of chain has its ends stapled to a gate post near the top thereof and a pair of pulleys are attached to the chain near its midpoint. A gate securing cable loop is trained over the two pulleys and embraces the top portion of one gate bar near the elevation of the chain. A retractile coil spring has one end thereof attached slidably to the cable loop and carries a spring clip at its other end which is selectively engageable with vertically spaced anchor staples on the adjacent gate post so that the tension of the spring can be regulated. During use, the spring is substantially vertical near the interior side of the gate post and causes the cable loop to hold the flexible gate taut in a closed position.

DETAILED DESCRIPTION

Figure 1:
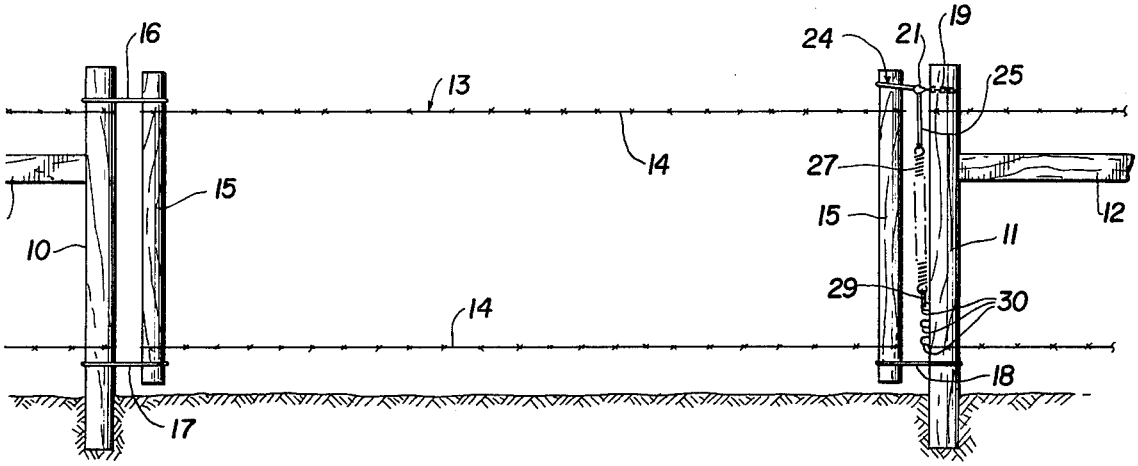
FIG. 1 is a side elevational view of a flexible farm gate equipped with the securing device according to the invention.
Figure 2:
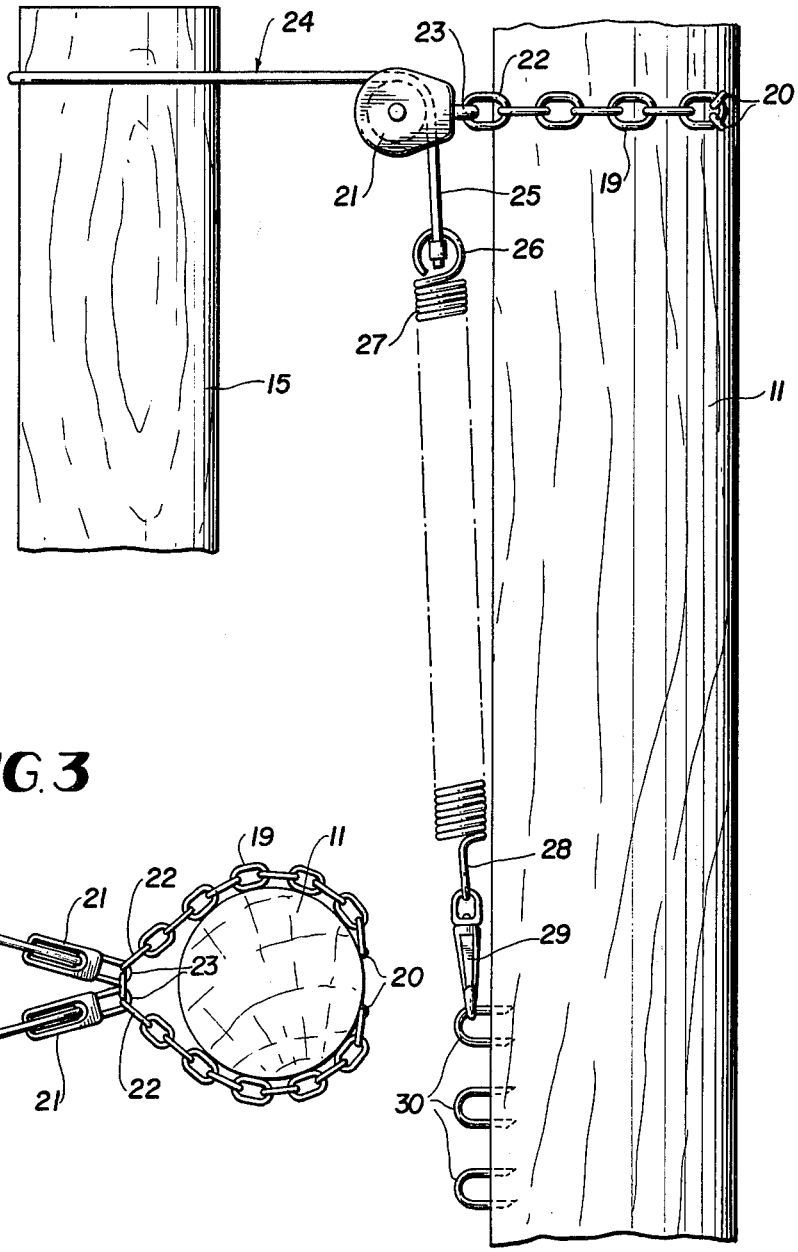
FIG. 2 is an enlarged side elevational view of the gate securing device.

Referring to the drawings in detail, wherein like numerals designate like parts, the numerals 10 and 11 designate fixed gate posts in an ordinary barbed wire farm fence line or ranch fence. The posts 10 and 11 are conventionally braced as at 12 for rigidity. A typical flexible gate 13 consists of two or more barbed wire strands 14 at different elevations, having their opposite ends connected to vertical gate bars 15 which lie inwardly of and parallel to the gate posts 10 and 11 when the gate is closed.

As shown in FIG. 1, the gate bar 15 is connected to the adjacent fixed post 10 near its top and bottom by wire loops 16 and 17, the loop 16 being lifted from the top of the post 10 to allow opening of the gate 13. Similarly, the other gate bar 15 is connected near its lower end to the post 11 by another wire loop 18. As thus far described, the structure is that of a conventional flexible farm gate.

Figure 3:
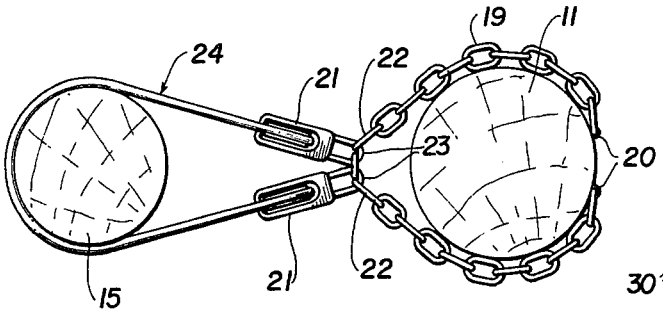
FIG. 3 is a plan view of the device.

The invention proper is a securing device for the top of the gate bar 15 adjacent the post 11 which serves to hold the gate 13 taut while in a closed position, FIG. 1, and allowing quick opening of the gate whenever desired. The invention comprises a single length of chain 19 whose opposite ends are stapled at 20, FIG. 3, to the fixed gate post 11 near the top thereof. A pair of pulleys 21 are connected to adjacent chain links 22 near the center of the chain section by suitable connecting elements 23. A cable loop 24 engages over the top of gate bar 15 and is trained over the two pulleys 21 in the manner shown and descends vertically at 25 below the pulleys and chain 19.

Cable loop 24 is connected as illustrated to the upper end terminal 26 of a substantially vertical retractile coil spring 27 which lies along the interior side of the post 11. A lower terminal 28 of spring 27 carries a spring clip 29 which is selectively engageable with any one of a group of vertically spaced anchor staples 30 fixed in the post 11 near the bottom of the gate. Thus, the tension of spring 27 can be regulated by attaching the clip 29 to different ones of the staples 30 at different elevations.

With the parts of the invention arranged as illustrated, the retractile spring 27 maintains tension on the cable loop 24 and this loop holds the gate 13 in a taut condition while closed and the tension on the gate can be adjusted, as described. To release the gate, it is merely necessary to press the left hand gate bar 15, FIG. 1, toward the gate post 10 and lift the retaining loop 16 from the top of gate bar 15, the spring 27 yielding to permit this operation.

The invention is extremely simple, very efficient and convenient in usage, and less expensive to manufacture than any of the prior art devices. The invention can be manufactured from standard commercial parts including chain, cable, pulleys and spring 27, including clip 29. The advantages of the device over the prior art should now be readily apparent.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A device for securing a flexible gate having a gate bar to a fixed gate post in a closed position, comprising a section of chain adapted to have its opposite ends anchored to the fixed gate post and at least partly surrounding the gate post near the upper end thereof, a pair of pulleys connected to said chain section near the longitudinal center thereof, a cable loop engaging said pulleys and adapted to be placed over the top of the gate bar, the cable loop adapted to extend below the elevation of said pulleys and chain section, a retractile spring having one end connected with said cable loop below the elevation of said pulleys, a clip on the other end of said spring, and anchoring means for mounting on the fixed gate post, said clip being engaged with said anchoring means.

2. A device for securing a flexible gate in a closed position as defined by claim 1, and staples structurally associated with said opposite ends of the chain section for anchoring said opposite ends of said chain section to the fixed gate post.

3. A device for securing a flexible gate in a closed position as defined by claim 1, and said anchoring means comprising a plurality of vertically spaced staples for mounting on the fixed gate post near the bottom of the flexible gate.

4. A device for securing a flexible gate in a closed position as defined by claim 1, and said clip being a snap type spring clip, said retractile spring having loop terminals on its opposite ends, one loop terminal connected to the cable loop and the other loop terminal connected to said spring clip.

5. A device for securing a flexible gate in a closed position as defined by claim 1, and said retractile spring extending substantially vertically during usage along the interior of the fixed gate post.

* * * * *